US008232716B2

(12) United States Patent
Kim et al.

(10) Patent No.: US 8,232,716 B2
(45) Date of Patent: Jul. 31, 2012

(54) FIELD EMISSION CATHODE CAPABLE OF AMPLIFYING ELECTRON BEAM AND METHODS OF CONTROLLING ELECTRON BEAM DENSITY

(75) Inventors: Yong Hyup Kim, Seoul (KR); Wal Jun Kim, Seoul (KR)

(73) Assignee: SNU R&DB Foundaton, Seoul (KR)

( * ) Notice: Subject to any disclaimer, the term of this patent is extended or adjusted under 35 U.S.C. 154(b) by 0 days.

(21) Appl. No.: 13/030,065

(22) Filed: Feb. 17, 2011

(65) Prior Publication Data

US 2011/0140602 A1 Jun. 16, 2011

Related U.S. Application Data

(62) Division of application No. 12/234,491, filed on Sep. 19, 2008, now Pat. No. 7,915,800.

(30) Foreign Application Priority Data

Aug. 19, 2008 (KR) ..... 10-2008-0080665

(51) Int. Cl.

| | |
|---|---|
| ***H01J 1/62*** | (2006.01) |
| ***H01J 63/04*** | (2006.01) |
| ***H01J 23/34*** | (2006.01) |
| ***H01J 29/98*** | (2006.01) |

(52) U.S. Cl. ..... 313/497; 313/495; 315/1

(58) Field of Classification Search ..... None
See application file for complete search history.

(56) References Cited

U.S. PATENT DOCUMENTS 7,045,947 B2 5/2006 Van Der Vaart et al.
2007/0063629 A1 3/2007 Tuck

FOREIGN PATENT DOCUMENTS

KR 10-2005-0122954 12/2005

OTHER PUBLICATIONS

Heo et al. (2007). Transmission-type microfocus x-ray tube using carbon nanotube field emitters. *Appl Phys. Lett.*, 90:1-3.
Prosecution History for U.S. Appl. No. 12/234,491, filed Sep. 19, 2008, through Feb. 17, 2011.
Zhang, X., et al., "Analysis of the transverse energy distribution of hopping electrons through a glass funnel," Applied Surface Science, vol. 251, Issues 1-4, pp. 182-190, Sep. 15, 2005.

*Primary Examiner* — Anh Mai
*Assistant Examiner* — Britt D Hanley
(74) *Attorney, Agent, or Firm* — Knobbe, Martens, Olson & Bear, LLP

(57) ABSTRACT

Field emission devices (FEDs) are provided. In one embodiment, an FED includes an electron emitter, a tube spaced apart from the electron emitter and having a first opening and a second opening, and a gate electrode disposed on an outer surface of the tube. The first opening is disposed at one end of the tube adjacent to the electron emitter, and the second opening is disposed at the other end of the tube. The FED further includes an anode that is spaced apart from the second opening and collects secondary electrons emitted from the second opening.

21 Claims, 7 Drawing Sheets

[Fig. 1]
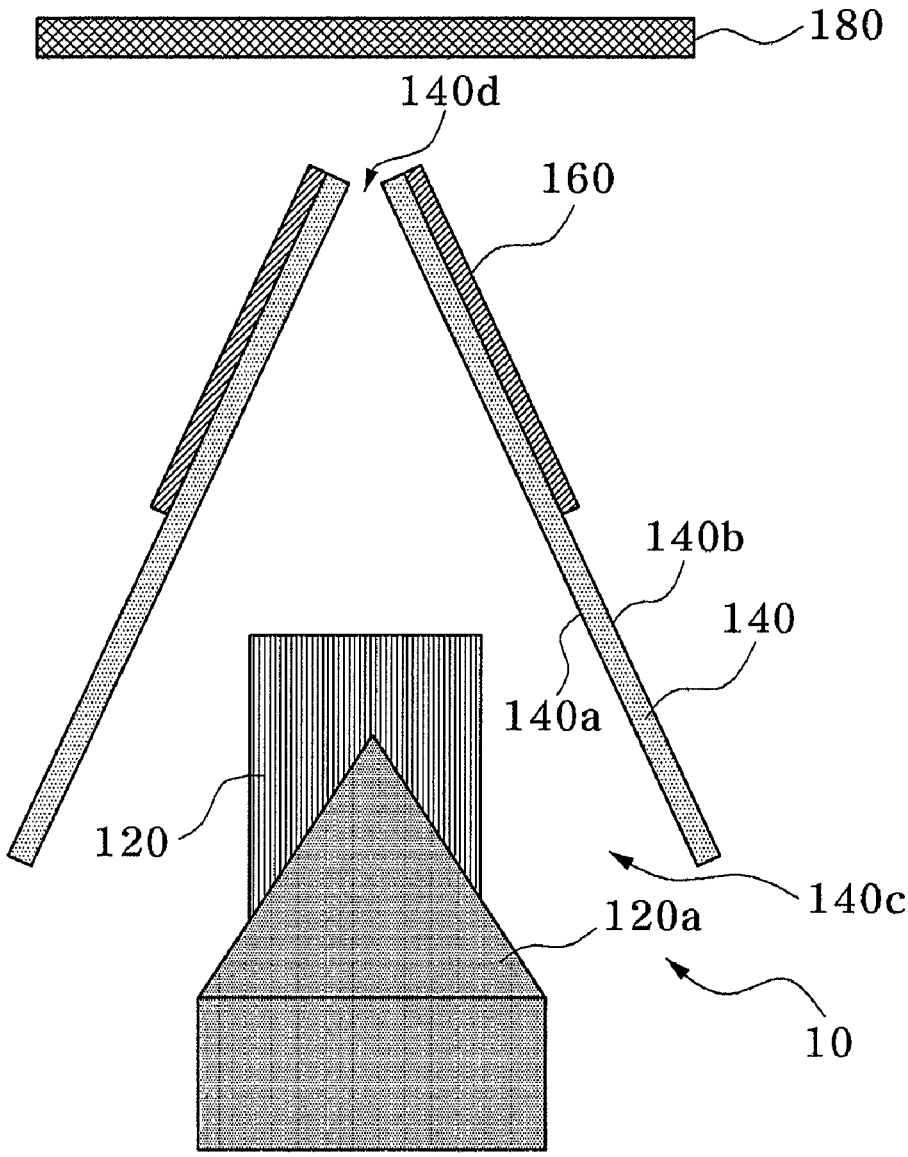

[Fig. 2]
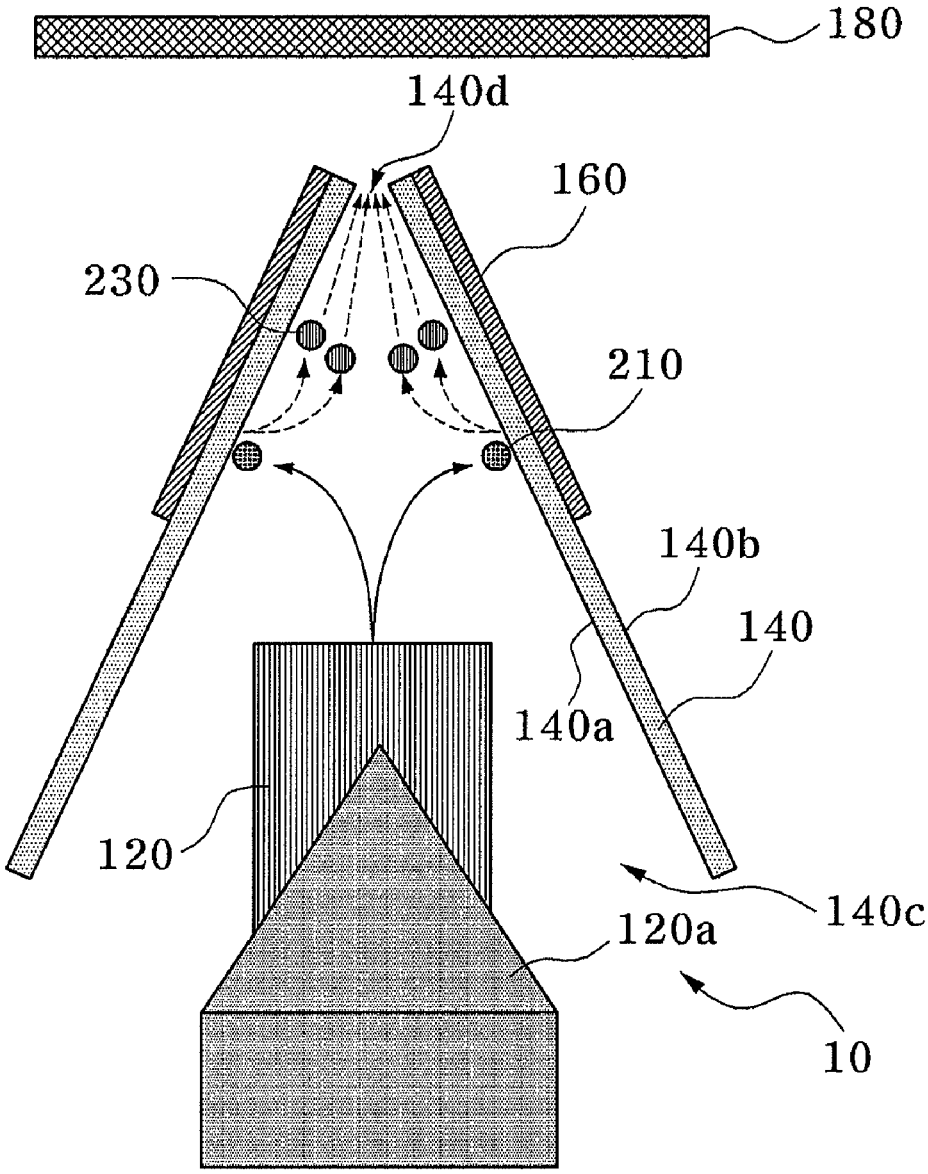

[Fig. 3]
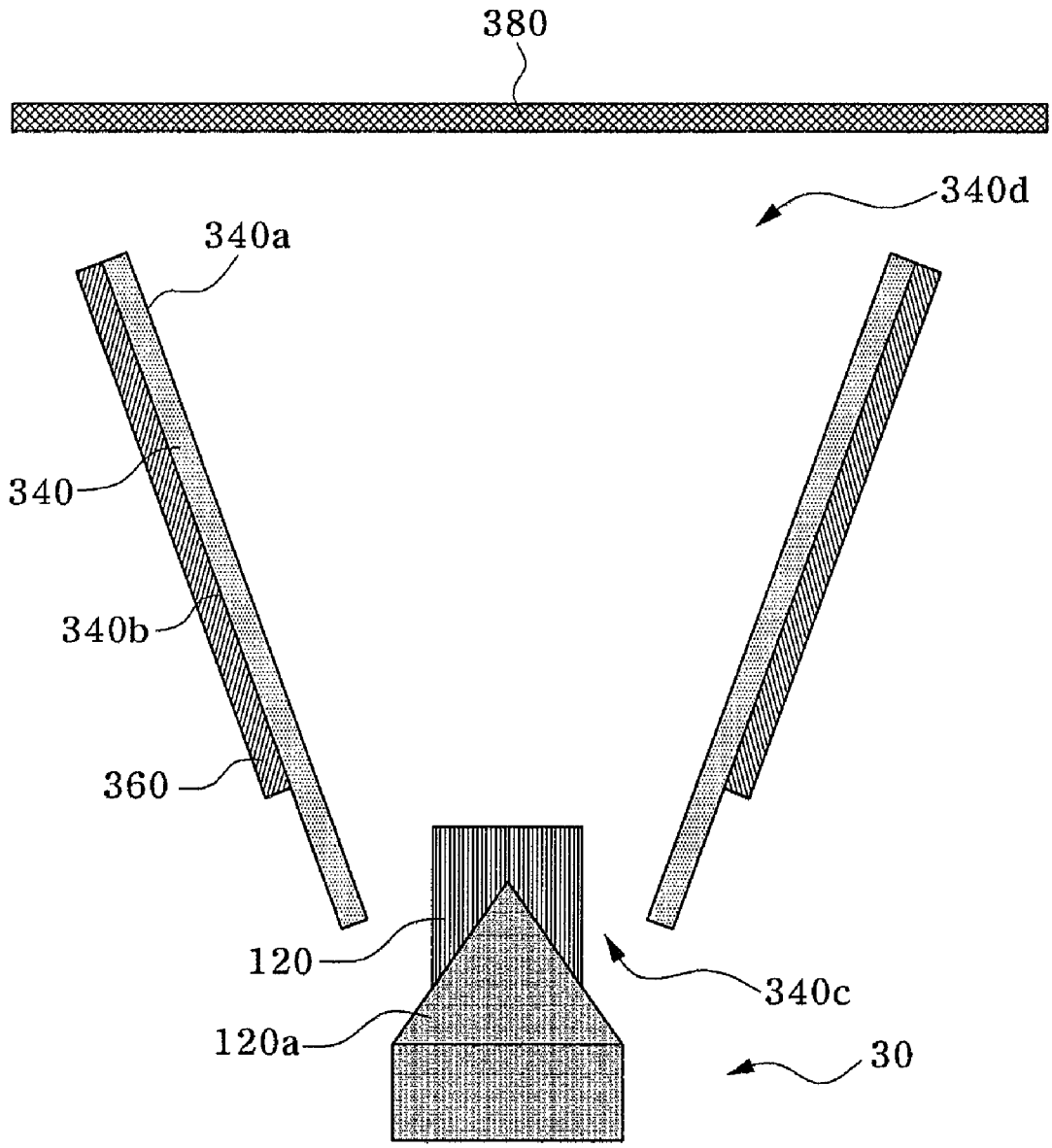

[Fig. 4]
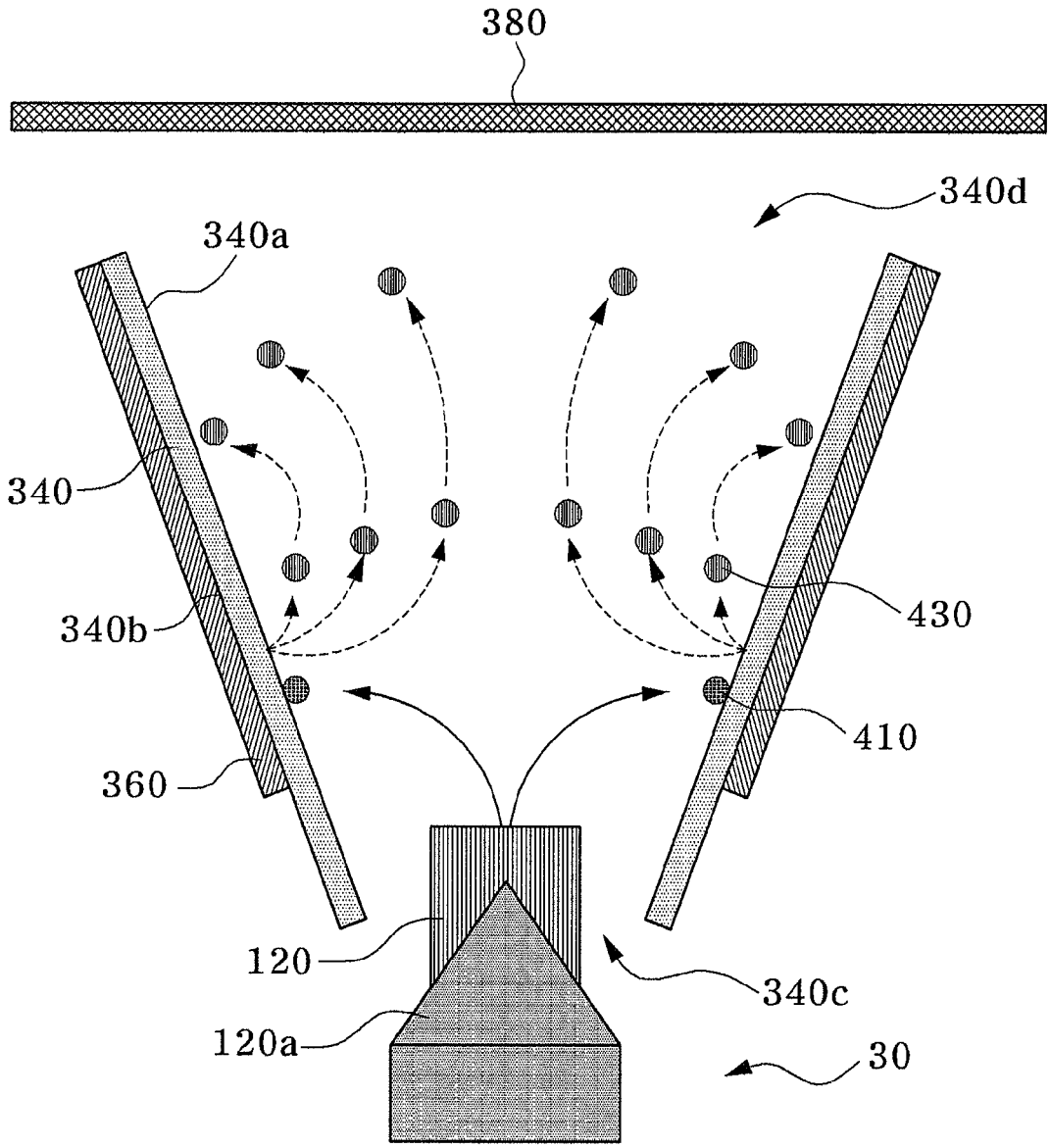

[Fig. 5]
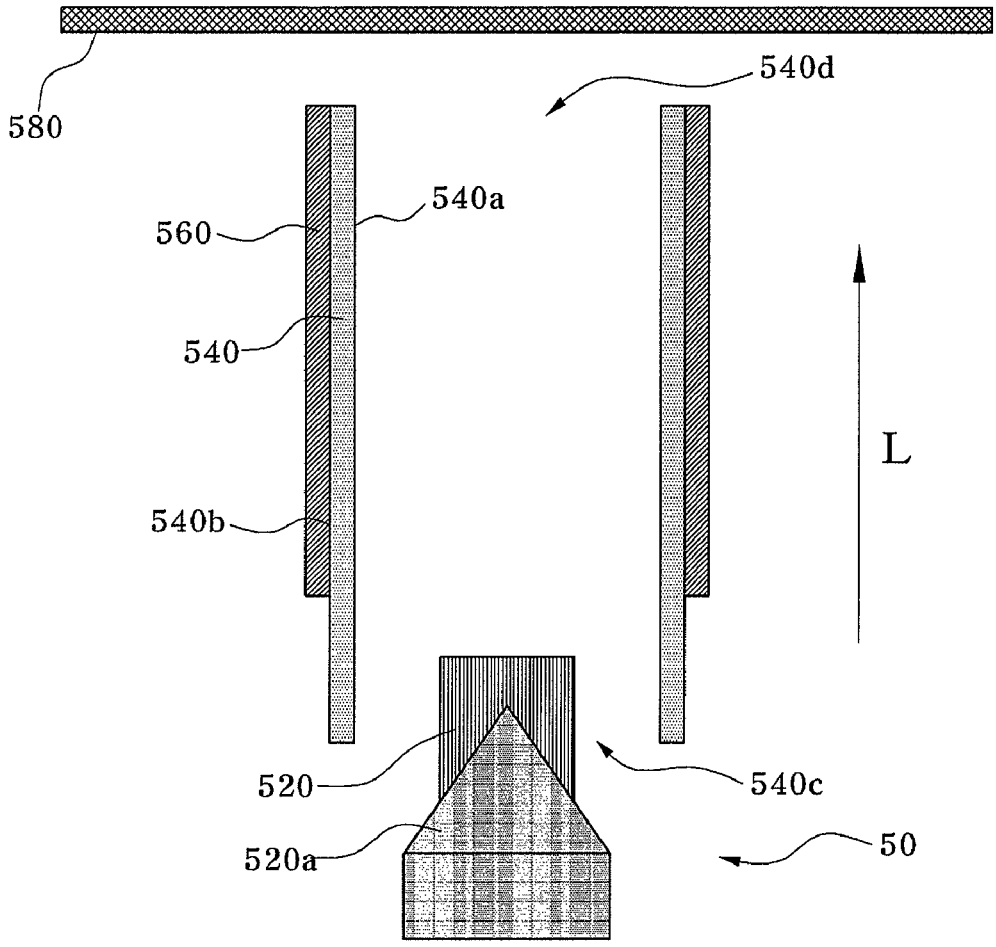

[Fig. 6]
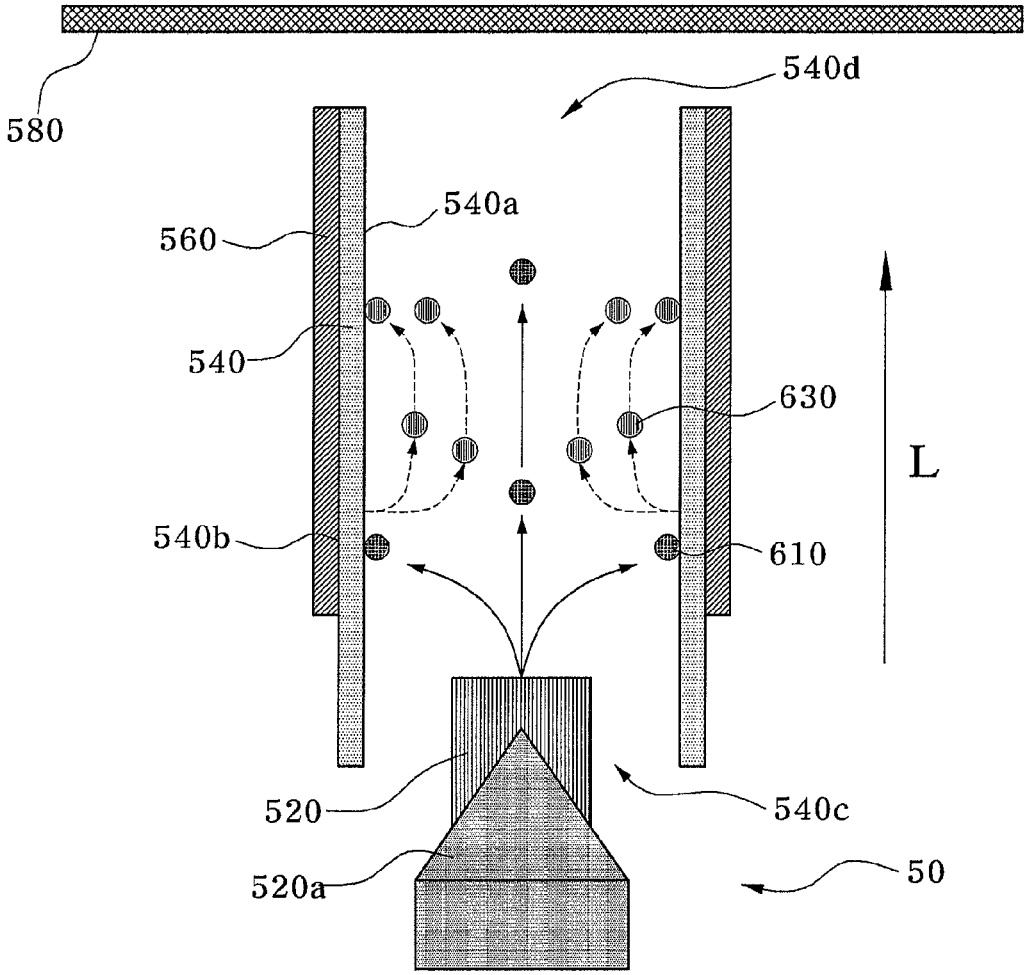

[Fig. 7]
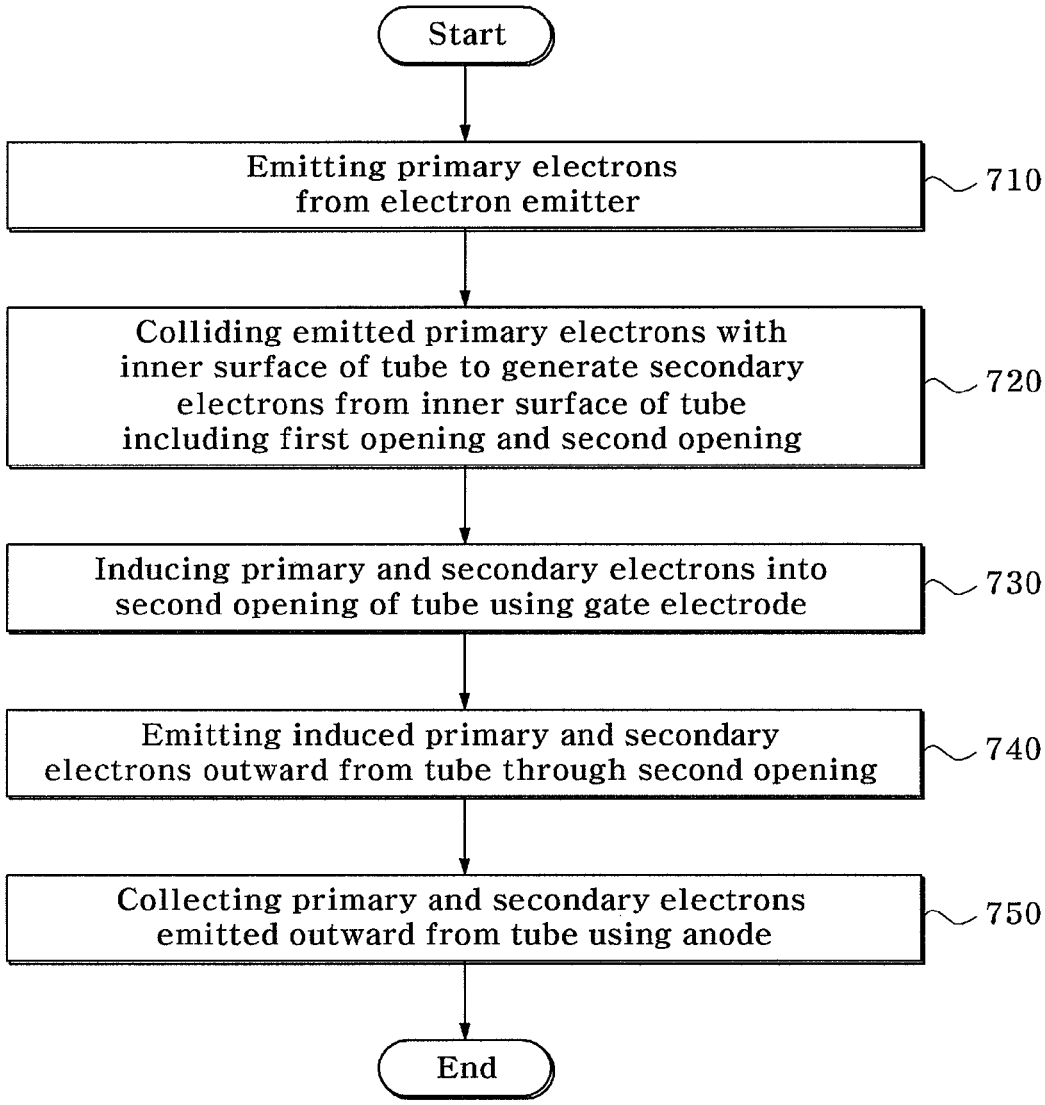

FIELD EMISSION CATHODE CAPABLE OF AMPLIFYING ELECTRON BEAM AND METHODS OF CONTROLLING ELECTRON BEAM DENSITY

CROSS-REFERENCE TO RELATED APPLICATIONS

This application claims priority under 35 U.S.C. §119 to Korean Patent Application No. 10-2008-0080665 filed on Aug. 19, 2008, the contents of which are herein incorporated by reference in their entirety. This application is also a divisional of U.S. application Ser. No. 12/235,491, filed Sep. 19, 2008, the contents of which are hereby incorporated by reference in their entirety.

TECHNICAL FIELD

The described technology relates generally to field emission devices and, more particularly, to field emission devices capable of controlling electron density.

BACKGROUND

A field emission device (FED) is widely employed as a field emission display, as an electron source of, for example, a scanning electron microscope (SEM) or transmission electron microscope (TEM), as an X-ray generator, as a gas ionizer, etc.

Typically, the FED applies an external electric field to a surface of an electron emitter so that electrons on the surface are emitted outward using quantum-mechanical tunneling. Various electron-emitting cathodes formed of a carbon-based material, metal or alloy may be used as the electron emitter for emitting electrons.

Meanwhile, electrons emitted from the electron emitter are changed into a form of electron beams and may be used for the field emission display, the SEM, the TEM, etc., as mentioned above. Moreover, an electric field or a magnetic field is separately applied to the emitted electrons to change the emitted electrons into the form of controlled electron beams. An X-ray tube including a field emitter having a carbon nanotube, a gate electrode, an anode, a solenoid lens, and an X-ray target is disclosed in S. H. Heo et al, "Applied Phys. Lett. 90, 183109 (2007)." The carbon nanotube formed on a tungsten tip emits electrons in response to an applied voltage. The gate electrode or the anode generates an electric field, and the solenoid lens generates a magnetic field. The electric field and the magnetic field modify the emitted electrons to be focused electron beams. Accordingly, the focused electron beams impact with the X-ray target to produce an X-ray.

One drawback is that a separate device is required for generating the electric or magnetic field to control the electron beams, which makes the whole structure complicated and costly to manufacture.

SUMMARY

In one embodiment, a field emission device (FED) includes an electron emitter, a tube spaced apart from the electron emitter and having a first opening and a second opening, and a gate electrode disposed on an outer surface of the tube. The first opening is disposed at one end of the tube adjacent to the electron emitter, and the second opening is disposed at the other end of the tube.

In another embodiment, an FED includes an electron emitter that emits primary electrons, a tube including a first opening and a second opening, a gate electrode and an anode. The first opening is disposed toward the electron emitter and the second opening has a smaller cross-sectional area than that of the first opening. The tube generates secondary electrons by collision of the primary electrons emitted from the electron emitter. The gate electrode focuses the primary and the secondary electrons into the second opening. The anode receives the primary and the secondary electrons focused into the second opening.

In still another embodiment, an FED includes an electron emitter that emits primary electrons, a tube including a first opening and a second opening, a gate electrode and an anode. The first opening is disposed toward the electron emitter and the second opening has a larger cross-sectional area than that of the first opening. The tube generates secondary electrons by collision of the primary electrons emitted from the first opening. The gate electrode diffuses the primary and the secondary electrons into the second opening. The anode receives the primary and the secondary electrons diffused into the second opening.

In still another embodiment, a method for driving an FED comprises emitting primary electrons from an electron emitter, colliding the emitted primary electrons with an inner surface of a tube to generate secondary electrons from the inner surface of the tube. The tube is spaced apart from the electron emitter and includes a first opening and a second opening. The first opening is formed at one end of the tube adjacent to the electron emitter and the second opening is formed at the other end of the tube. The method also comprises inducing the primary and the secondary electrons into the second opening of the tube using a gate electrode, and emitting the induced primary and secondary electrons outward from the tube through the second opening. The gate electrode disposed on an outer surface of the tube.

The Summary is provided to introduce a selection of concepts in a simplified form that are further described below in the Detailed Description. The Summary is not intended to identify key features or essential features of the claimed subject matter, nor is it intended to be used as an aid in determining the scope of the claimed subject matter.

BRIEF DESCRIPTION OF THE DRAWINGS

FIG. 1 is a cross-sectional view of a field emission device (FED) in one embodiment.

FIG. 2 is a diagram schematically illustrating the operation of the FED of FIG. 1 in one embodiment.

FIG. 3 is a cross-sectional view of an FED in another embodiment.

FIG. 4 is a diagram schematically illustrating the operation of the FED of FIG. 3 in one embodiment.

FIG. 5 is a cross-sectional view of an FED in still another embodiment.

FIG. 6 is a diagram schematically illustrating the operation of the FED of FIG. 5 in one embodiment.

FIG. 7 is a flowchart illustrating a method for driving an FED in one embodiment.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the components of the present disclosure, as generally described herein, and illustrated in the Figures, can be arranged, substituted, combined, and designed in a wide variety of different configurations, all of which are explicitly contemplated and make part of this disclosure.

It will also be understood that when an element or layer is referred to as being "on," another element or layer, the element or layer may be directly on the other element or layer or intervening elements or layers may be present. As used herein, the term "and/or" may include any and all combinations of one or more of the associated listed items. In addition, electron, primary electron or secondary electron may designate one electron or a plurality of electrons.

First Embodiment

FIG. 1 is a cross-sectional view of a field emission device (FED) in one embodiment, and FIG. 2 is a diagram schematically illustrating the operation of the FED of FIG. 1 in one embodiment. As depicted in FIGS. 1 and 2, an FED 10 includes an electron emitter 120, a tube 140 and a gate electrode 160. The FED 10 may optionally further include an anode 180.

The electron emitter 120 emits primary electrons 210. The electron emitter 120 may be made of a carbon-based material such as, by way of example, graphite, diamond or carbon nanotube, a metal such as, by way of example, tungsten, nickel, aluminum, molybdenum, tantalum or niobium, or an alloy thereof In one embodiment, the electron emitter 120 is disposed on a cathode 120*a*. The cathode 120*a* may be made of a metal such as, by way of example, tungsten, nickel, aluminum, molybdenum, tantalum or niobium, or an alloy thereof. The cathode 120*a* may include a pointed metal tip. For example, when the cathode 120*a* is made of tungsten, a tungsten wire may be electrochemically etched by a potassium hydroxide solution or a sodium hydroxide solution to form the pointed tungsten tip. The electron emitter 120 may be formed around the pointed metal tip of the cathode 120*a*.

The tube 140 is spaced apart from the electron emitter 120. In one embodiment, the tube 140 is disposed above the electron emitter 120*a*. The tube 140 includes a first opening 140*c* disposed at one end thereof adjacent to the electron emitter 120 and a second opening 140*d* disposed at the other end thereof An inner surface 140*a* of the tube 140 may surround the electron emitter 120. The size of the second opening 140*d* may be smaller than that of the first opening 140*c*. In one embodiment, a cross-sectional area of the second opening 140*d* may be smaller than that of the first opening 140*c*. In one embodiment, an inner cross-sectional area of the tube 140 may decrease from the first opening toward the second opening.

The tube 140 may be formed to have any shape as long as the size of the second opening 140*d* is smaller than the size of the first opening 140*c*. In one embodiment, when the tube 140 is taken along a horizontal surface, the tube 140 may be a truncated cone having a cross-sectional shape of the opening being a circle, or a polygonal cone having a cross-sectional shape of the opening being a polygon.

The entire tube 140 may be made of an insulator. Alternatively the tube 140 may include the insulator formed on the inner surface 140*a*. For example, the insulator may include glass, $Al_2O_3$, BeO, $SiO_2$, MgO, CaO, ZnO, SrO, BaO, $CaF_2$, LiF, $BaF_2$, NaF, NaCl, KCl, NaBr, RbCl, KBr, NaI, KI, CsCl, or combinations thereof.

In one embodiment, when the tube 140 includes the insulator formed on the inner surface 140*a*, the insulator may be formed by, for example, a chemical vapor deposition (CVD) method or a physical vapor deposition (PVD) method. As illustrated in FIG. 2, the primary electrons 210 may be emitted from the electron emitter 120 toward the tube 140 and the primary electrons 210 may collide with the inner surface 140*a* of the tube 140. Accordingly, chemical bonds of electrons combined to atoms inside the inner surface 140*a* may be broken so that the electrons may escape from the atoms. Consequently, the electrons released from the atoms may be emitted outward from the inner surface 140*a* of the tube 140 as secondary electrons 230.

The gate electrode 160 is disposed on an outer surface 140*b* of the tube 140. The gate electrode 160 may be formed on a portion of the outer surface 140*b* of the tube 140. Alternatively, the gate electrode 160 may be formed on all of the (i.e., the entire) outer surface 140*b* of the tube 140. The gate electrode 160 may be made of a conductive material such as, for example, indium tin oxide (ITO), indium zinc oxide (IZO), zinc oxide (ZnO), $In_2O_3$, Al, Cu, Au, Ag, Pt, Ti, Fe, Co, Ta, W, etc.

The gate electrode 160 may have a positive potential with respect to the cathode 120*a*. The gate electrode 160 may electrostatically interact with the primary electrons 210 emitted from the electron emitter 120 to accelerate the primary electrons 210 toward the inner surface 140*a* of the tube 140. The accelerated primary electrons 210 may collide with the inner surface 140*a* of the tube 140 to allow the secondary electrons 230 to be emitted from the inner surface 140*a* of the tube 140. In addition, the gate electrode 160 may electrostatically interact with the primary electrons 210 and the secondary electrons 230 to allow the primary electrons 210 and the secondary electrons 230 to repeatedly collide with the inner surface 140*a* of the tube 140 so that new secondary electrons 230 may be generated and emitted from the inner surface 140*a* of the tube 140. In addition, the gate electrode 160 may induce the primary electrons 210 and the secondary electrons 230 into the second opening 140*d* of the tube 140 using the electrostatic interaction with the primary electrons 210 and the secondary electrons 230.

As illustrated in FIGS. 1 and 2, a cross-sectional area of the second opening 140*d* is smaller than a cross-sectional area of the first opening 140*c*, and thus the primary electrons 210 and the secondary electrons 230 may be gathered and be focused toward the second opening 140*d* of the tube 140 due to the geometry of the tube 140 and the electrostatic interaction with the gate electrode 160. At this time, the density of the primary electrons 210 and the secondary electrons 230 focused into the second opening 140*d* may be adjusted by changing a cross-sectional area ratio of the first opening 140*c* and the second opening 140*d*. The density of the focused primary electrons 210 and secondary electrons 230 may generate a current density at the second opening 140*d*. The generated current density may be proportional to a yield of the secondary electrons emitted from the inner surface 140*a* of the tube 140, a cross-sectional area of the cathode 120*a* and a current density of the cathode 120*a*, and may be inversely proportional to a cross-sectional area of the second opening 140*d*. The density-adjusted electrons may be emitted outward from the tube 140 through the second opening 140*d*.

In one embodiment, the anode 180 is disposed in a manner as to be spaced apart from the second opening 140*d*. The anode 180 applies an electric field to the primary electrons 210 and the secondary electrons 230 at the second opening 140*d* to collect the primary electrons 210 and the secondary electrons 230. The anode 180 may have a positive potential larger than that of the gate electrode 160, thus preventing the primary electrons 210 and the secondary electrons 230 emitted outward from the tube 140 from reentering (i.e., going back into) the tube 140. The anode 180 may be made of a conductive material which is well known to those skilled in the art.

As described above, the FED of the first embodiment includes a tube having first and second openings and a gate electrode. The tube emits secondary electrons by colliding with primary electrons. The gate electrode causes the primary electrons and the secondary electrons to repeatedly collide with the tube to generate new secondary electrons so that the density of the secondary electrons may increase. In addition, the gate electrode may induce the primary electrons and the secondary electrons into the second opening for focusing. Therefore, the current density generated by the primary electrons and the secondary electrons emitted through the second opening may be higher than the current density generated by the primary electrons emitted from an electron emitter. Consequently, the tube and the gate electrode applied to the FED may result in high current density caused by the high electron density at the second opening.

In addition, the FED of the first embodiment may control the focusing of the first and the second electrons moving along the inside of the tube by changing a ratio of sizes of the first and the second openings. The FED may have a simple structure and a low manufacturing cost compared to the conventional device applying an electric field and a magnetic field to focus electrons.

Second Embodiment

FIG. 3 is a cross-sectional view of an FED in another embodiment, and FIG. 4 schematically illustrates the operation of the FED of FIG. 3 in one embodiment. As illustrated in FIGS. 3 and 4, an FED 30 includes an electron emitter 320, a tube 340, and a gate electrode 360. The FED 30 may optionally further include an anode 380.

In one embodiment, the electron emitter 320 is disposed on a cathode 320*a*. The electron emitter 320 and the cathode 320*a* are substantially the same as the electron emitter 120 and the cathode 120*a* described with reference to FIGS. 1 and 2.

As illustrated, the tube 340 is spaced apart from the electron emitter 320. In one embodiment, the tube 340 is disposed above the electron emitter 320. The tube 340 includes a first opening 340*c* disposed at one end of the tube adjacent to the electron emitter 320 and a second opening 340*d* disposed at the other end of the tube.

An inner surface 340*a* of the tube 340 may surround the electron emitter 320. The size of the second opening 340*d* may be larger than that of the first opening 340*c*. In one embodiment, a cross-sectional area of the second opening 340*d* may be larger than that of the first opening 340*c*. In one embodiment, an inner cross-sectional area of the tube 340 may increase from the first opening 340*c* toward the second opening 340*d*.

The tube 340 may be formed to have any shape as long as the size of the second opening 340*d* is larger than the size of the first opening 340*c*. In one embodiment, when the tube 340 is taken along a horizontal surface, the tube 340 may be a truncated cone having a cross-sectional shape of the opening being a circle, or a polygonal cone having a cross-sectional shape of the opening being a polygon.

The entire tube 340 may be made of an insulator. Alternatively, the tube 340 may include the insulator formed on the inner surface 340*a*. For example, the insulator may include glass, $Al_2O_3$, BeO, $SiO_2$, MgO, CaO, ZnO, SrO, BaO, $CaF_2$, LiF, $BaF_2$, NaF, NaCl, KCl, NaBr, RbCl, KBr, NaI, KI, CsCl, or combinations thereof In one embodiment, when the tube 340 includes the insulator formed on the inner surface 340*a*, the insulator may be formed by, for example, a CVD method or a PVD method. As illustrated in FIG. 4, primary electrons 410 may be emitted from the electron emitter 320 toward the tube 340 and the primary electrons 410 may collide with the inner surface 340*a* of the tube 340. Accordingly, chemical bonds of electrons combined to atoms inside the inner surface 340*a* may be broken so that the electrons may escape from the atoms. Consequently, the electrons released from the atoms may be emitted from the inner surface 340*a* of the tube 340 as secondary electrons 430.

The gate electrode 360 is disposed on an outer surface 340*b* of the tube 340. The gate electrode 360 may be formed on a portion of the outer surface 340*b* of the tube 340. Alternatively, the gate electrode 360 may be formed on all of the (i.e., the entire) outer surface 340*b* of the tube 340. The gate electrode 360 may be made of a conductive material such as, for example, ITO, IZO, ZnO, $In_2O_3$, Al, Cu, Au, Ag, Pt, Ti, Fe, Co, Ta, W, etc.

The gate electrode 360 may have a positive potential with respect to the cathode 320*a*. The gate electrode 360 may electrostatically interact with the primary electrons 410 emitted from the electron emitter 320 to accelerate the primary electrons 410 toward the inner surface 340*a* of the tube 340. The accelerated primary electrons 410 may collide with the inner surface 340*a* of the tube 340 to allow the secondary electrons 430 to be emitted from the inner surface 340*a* of the tube 340. In addition, the gate electrode 360 may electrostatically interact with the primary electrons 410 and the secondary electrons 430 to allow the primary electrons 410 and the secondary electrons 430 to repeatedly collide with the inner surface 340*a* of the tube 340 so that new secondary electrons 430 may be generated and emitted from the inner surface 340*a* of the tube 340. In addition, the gate electrode 360 may induce the primary electrons 410 and the secondary electrons 430 into the second opening 340*d* of the tube 340 using the electrostatic interaction between the gate electrode 360 and the primary electrons 410 and the secondary electrons 430.

As illustrated in FIGS. 3 and 4, a cross-sectional area of the second opening 340*d* of the tube 340 is larger than a cross-sectional area of the first opening 340*c*, and thus the primary electrons 410 and the secondary electrons 430 induced by the gate electrode 360 may be diffused toward the second opening 340*d* of the tube 340 due to the geometry of the tube 340. When the primary electrons 410 and the secondary electrons 430 are diffused toward the second opening 340*d* along the tube 340, the primary electrons 410 and the secondary electrons 430 may have a uniform electron density due to the electrostatic attraction between the primary and the secondary electrons 410, 430 and the gate electrode 360, and due to electrostatic repulsion between the primary and the secondary electrons 410, 430. The primary electrons 410 and the secondary electrons 430 having the uniform electron density may be diffused and distributed with uniform energy at the second opening 340*d*. Then, the primary electrons 410 and the secondary electrons 430 may be emitted outward from the tube 340 through the second opening 340*d*.

In one embodiment, the anode 380 is disposed in a manner as to be spaced apart from the second opening 340*d*. The anode 380 applies an electric field to the primary electrons 410 and the secondary electrons 430 at the second opening 340*d* to collect the primary electrons 410 and the secondary electrons 430. The anode 380 may have a positive potential larger than that of the gate electrode 360, and thus preventing the primary electrons 410 and the secondary electrons 430 emitted outward from the tube 340 from reentering (i.e., go back into) the tube 340. The anode 380 may be made of a conductive material which is well known to those skilled in the art.

As described above, the FED of the second embodiment includes a tube having first and second openings and a gate electrode. The tube emits secondary electrons by colliding with primary electrons. The gate electrode causes the primary electrons and the secondary electrons to repeatedly collide with the tube to generate new secondary electrons so that the density of the secondary electrons may increase. In addition, the gate electrode may induce and diffuse the primary electrons and the secondary electrons into the second opening. Therefore, the primary and the secondary electrons emitted through the second opening may be controlled to have uniform energy in a larger space compared to the primary electrons emitted from an electron emitter.

In addition, the FED of the second embodiment may control the diffusion of the first and the second electrons moving along the inside of the tube by changing a ratio of sizes of the first and second openings. The FED may have a simple structure and a low manufacturing cost compared to the conventional device applying an electric field and a magnetic field to control electrons.

Third Embodiment

FIG. 5 is a cross-sectional view of an FED in one embodiment, and FIG. 6 schematically illustrates the operation of the FED of FIG. 5 in one embodiment. As illustrated in FIGS. 5 and 6, an FED 50 includes an electron emitter 520 disposed on a cathode 520*a*, a tube 540, and a gate electrode 560. The FED 50 may optionally further include an anode 580.

Elements of the FED 50 except for the shape of the tube 540 are substantially the same as those of the FED 10 or 30. For example, the electron emitter 520, the cathode 520*a*, the gate electrode 560 and the anode 580 are substantially the same as the electron emitters 120 or 320, the cathodes 120*a* or 320*a*, the gate electrodes 160 or 360, and the anodes 180 or 380 of either one of the first and second embodiments described with reference to FIGS. 1 to 4.

As illustrated in FIGS. 5 and 6, a first opening 540*c* and a second opening 540*d* of the tube 540 have substantially the same size as each other. In one embodiment, a cross-sectional area of the second opening 540*d* may be substantially the same as that of the first opening 540*c*. In one embodiment, an inner cross-sectional area of the tube 540 may be the same along a longitudinal direction L of the tube 540.

The tube 540 may be formed to have any shape as long as the size of the second opening 540*d* is substantially the same as that of the first opening 540*c*.

In one embodiment, since the sizes of first and second openings of the tube 540 are substantially the same as each other, primary electrons 610 and secondary electrons 630 may travel along the inside of the tube 540 toward the second opening 540*d*, without being spatially diffused or focused and with increasing the electron density.

A method for driving an FED according to an embodiment of the present disclosure will now be described.

FIG. 7 is a flowchart illustrating a method for driving an FED in one embodiment. The FED may be any one of the FEDs described above with reference to the first, second, and third embodiments. Beginning in block 710, an electron emitter of the FED emits primary electrons. The electron emitter may emit the primary electrons when an external voltage is applied to the electron emitter, and thus an electric field is formed between a gate electrode and the electron emitter of the FED.

In block 720, the emitted primary electrons collide with an inner surface of a tube so that the secondary electrons are generated from the inner surface of the tube. In this case, the tube may be spaced apart from the electron emitter and may include a first opening and a second opening. A gate electrode disposed on an outer surface of the tube may electrostatically interact with the primary electrons and the secondary electrons to induce the primary electrons and the secondary electrons into the second opening of the tube. The induced secondary electrons may be focused or diffused toward the second opening depending on the type of the tube.

In block 730, the gate electrode induces the primary electrons and the secondary electrons into the second opening of the tube. The gate electrode may have a positive potential with respect to the electron emitter. The gate electrode may electrostatically interact with the primary electrons emitted from the electron emitter to accelerate the primary electrons toward the inner surface of the tube. The accelerated primary electrons may collide with the inner surface of the tube to allow the secondary electrons to be generated from the inner surface of the tubes.

In block 740, the induced primary and the induced secondary electrons are emitted outward from the tube through the second opening. In one embodiment, when the induced secondary electrons are focused along the tube, the density of the secondary electrons at the second opening may be higher than the density of the primary electrons emitted from the electron emitter. In another embodiment, when the induced secondary electrons are diffused along the tube, the secondary electrons at the second opening may have more uniform energy in a larger space compared to that of the primary electrons emitted from the electron emitter.

In block 750, an anode collects the primary and the secondary electrons emitted outward from the tube. The anode is disposed to be spaced apart from the second opening.

According to the method for driving the FED of the embodiment of the present disclosure, various densities of electrons may be provided depending on the type of a tube. In addition, electrons passing through the tube may be focused or diffused by a physical method, so that the FED may have a simple structure and a low cost for controlling the electrons compared to the conventional method of controlling electrons using electric and magnetic fields.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method for driving a FED, comprising:

emitting primary electrons from an electron emitter;

colliding the emitted primary electrons with an inner surface of a tube to generate secondary electrons from the inner surface of the tube, wherein the tube is spaced apart from the electron emitter and comprises a first opening and a second opening, the first opening is formed at one end of the tube adjacent to the electron emitter and the second opening is formed at the other end of the tube;

inducing the primary and the secondary electrons into the second opening of the tube using a gate electrode, the gate electrode disposed on an outer surface of the tube, wherein the gate electrode extends in a longitudinal direction between the first opening of the tube and the second opening of the tube; and emitting the induced primary and secondary electrons outward from the tube through the second opening.

2. The method of claim 1, wherein the inner surface of the tube surrounds the electron emitter.

3. The method of claim 1, wherein the tube comprises at least one insulator selected from the group consisting of glass, $Al_2O_3$, BeO, $SiO_2$, MgO, CaO, ZnO, SrO, BaO, $CaF_2$, LiF, $BaF_2$, NaF, NaCl, KCl, NaBr, RbCl, KBr, NaI, KI and CsCl.

4. The method of claim 1, wherein colliding the emitted primary electrons comprises repeatedly colliding the primary and the secondary electrons with the inner surface of the tube using the gate electrode.

5. The method of claim 1, wherein the second opening has a smaller size than that of the first opening.

6. The method of claim 5, wherein an inner cross-sectional area of the tube decreases from the first opening toward the second opening.

7. The method of claim 5, wherein inducing the primary and the secondary electrons into the second opening of the tube comprises focusing the primary and the secondary electrons using the gate electrode into the second opening of the tube.

8. The method of claim 7, wherein a current density generated by the primary and the secondary electrons focused into the second opening of the tube is proportional to a yield of the secondary electrons emitted from the tube, a cross-sectional area of a cathode where the electron emitter is disposed and a current density of the cathode, and is inversely proportional to a cross-sectional area of the second opening.

9. The method of claim 1, wherein the second opening has a larger size than that of the first opening.

10. The method of claim 9, wherein inducing the primary and the secondary electrons into the second opening of the tube comprises diffusing the primary and the secondary electrons using the gate electrode into the second opening of the tube.

11. The method of claim 1, wherein the second opening has substantially the same size as that of the first opening.

12. The method of claim 1, further comprising:

collecting the primary and the secondary electrons emitted outward from the tube using an anode, the anode disposed to be spaced apart from the second opening.

13. The method of claim 1, wherein the entire tube is made of an insulator.

14. The method of claim 1, wherein the tube includes an insulator on an inner surface of the tube.

15. A method comprising:

emitting primary electrons along a longitudinal axis of a tube, wherein the longitudinal axis extends from a first opening at a first end of the tube to a second opening at a second end of the tube; and applying a first electric field configured to induce the primary electrons to collide with an inner surface of the tube, wherein the first electric field is produced by a gate electrode disposed on an outer surface of the tube and extending from the first opening of the tube to the second opening of the tube.

16. The method of claim 15, further comprising applying a second electric field configured to withdraw electrons from the second opening.

17. A method comprising:

emitting primary electrons along a longitudinal axis of a tube, wherein the longitudinal axis extends from a first a opening at a first end of the tube to a second opening at a second end of the tube;

applying a first electric field configured to induce the primary electrons to collide with an inner surface of the tube; and applying a second electric field configured to withdraw electrons from the second opening, wherein the first electric field and the second electric field have different directions.

18. The method claim 17, wherein the second electric field has a positive potential larger than the first electric field.

19. The method of claim 15, further comprising colliding the primary electrons with the tube to produce secondary electrons.

20. The method of claim 17, wherein applying the second electric field configured to withdraw electrons from the second opening comprises applying the second electric field such that the second electric extends along the longitudinal axis of the tube.

21. The method of claim 16, wherein applying the second electric field configured to withdraw electrons from the second opening comprises applying a potential to an anode such that electrons are received from the second opening.

* * * * *

UNITED STATES PATENT AND TRADEMARK OFFICE

CERTIFICATE OF CORRECTION

PATENT NO. : 8,232,716 B2
APPLICATION NO. : 13/030065
DATED : July 31, 2012
INVENTOR(S) : Kim et al.

It is certified that error appears in the above-identified patent and that said Letters Patent is hereby corrected as shown below:

On the Title Page, in Item (56), under "OTHER PUBLICATIONS", in Column 2, Line 2, delete "Appl" and insert -- Appl. --, therefor.

In Column 3, Line 32, delete "thereof" and insert -- thereof. --, therefor.

In Column 3, Line 49, delete "thereof" and insert -- thereof. --, therefor.

In Column 6, Line 6, delete "thereof" and insert -- thereof. --, therefor.

In Column 10, Line 24, in Claim 17, delete "a first a" and insert -- a first --, therefor.

In Column 10, Line 34, in Claim 18, delete "method" and insert -- method of --, therefor.

Signed and Sealed this
Twenty-seventh Day of November, 2012

David J. Kappos

David J. Kappos
*Director of the United States Patent and Trademark Office*